US008362702B2

(12) United States Patent
Yu et al.

(10) Patent No.: US 8,362,702 B2
(45) Date of Patent: Jan. 29, 2013

(54) LOCAL DIMMING CONTROL METHOD AND APPARATUS OF EDGE-TYPE BACKLIGHT MODULE

(75) Inventors: Chia-Lei Yu, Taipei (TW); Tzueng-Yau Lin, Taichung County (TW)

(73) Assignee: Mediatek Inc., Science-Based Industrial Park, Hsin-Chu (TW)

( * ) Notice: Subject to any disclaimer, the term of this patent is extended or adjusted under 35 U.S.C. 154(b) by 276 days.

(21) Appl. No.: 12/696,043

(22) Filed: Jan. 28, 2010

(65) Prior Publication Data

US 2011/0181202 A1 Jul. 28, 2011

(51) Int. Cl.
*G09G 3/10* (2006.01)
*G09F 1/00* (2006.01)

(52) U.S. Cl. ..... 315/169.3; 315/291

(58) Field of Classification Search .... 315/169.3–169.4, 315/307, 224, 291, 312, 204, 690, 691; 345/204, 345/690, 691, 698, 699, 55, 63, 76, 77, 82, 345/84

See application file for complete search history.

(56) References Cited

U.S. PATENT DOCUMENTS

| | | | | |
|---|---|---|---|---|
| 7,658,528 | B2 * | 2/2010 | Hoelen et al. | 362/555 |
| 2008/0309611 | A1 * | 12/2008 | Yang | 345/102 |
| 2009/0015755 | A1 | 1/2009 | Bang | |
| 2009/0027592 | A1 * | 1/2009 | Motomatsu | 349/64 |
| 2009/0140665 | A1 * | 6/2009 | Park | 315/291 |

* cited by examiner

*Primary Examiner* — Minh D A
(74) *Attorney, Agent, or Firm* — Winston Hsu; Scott Margo

(57) ABSTRACT

A local dimming control method and apparatus of an edge-type backlight module are provided. The edge-type backlight module has a plurality of backlight units positioned at at least one side of a display area. The local dimming control apparatus includes: a configuration unit, for dividing the display area into a plurality of display blocks; and a local dimming control unit, coupled to the configuration unit, for setting respective backlight intensities of the display blocks through controlling a plurality of luminance settings of the backlight units. The local dimming control method includes: dividing the display area into a plurality of display blocks; and performing a local dimming control operation to set respective backlight intensities of the display blocks through controlling a plurality of luminance settings of the backlight units.

20 Claims, 7 Drawing Sheets

LOCAL DIMMING CONTROL METHOD AND APPARATUS OF EDGE-TYPE BACKLIGHT MODULE

BACKGROUND

The disclosed embodiments of the present invention relate to controlling a backlight module, and more particularly, to a local dimming control apparatus and method of an edge-type backlight module.

In a conventional liquid crystal display (LCD) apparatus, a light source of a direct-type backlight module is commonly implemented by fluorescent tube(s). Due to the advance of the LCD technology, a partially-driven direct-type backlight module is developed, where a number of point light sources, such as light emitting diodes (LEDs), are used in a plurality of backlight units disposed below a plurality of regions of a display panel and implemented for illuminating the regions, respectively and independently. Therefore, the light intensity of the backlight module is partially changed rather than globally changed, which can improve the display quality of the video image.

However, due to consideration of low cost and small size, an edge-type backlight module is preferred. The conventional edge-type backlight module has a number of point light sources, such as LEDs arranged at a side of the LCD panels. As the local dimming control of the backlight module would affect the final display quality of the video image, how to properly control the edge-type backlight module becomes an important topic to designers in this field.

SUMMARY

In accordance with exemplary embodiments of the present invention, a local dimming control apparatus and method of an edge-type backlight module are proposed.

According to one aspect of the present invention, a local dimming control apparatus of an edge-type backlight module is proposed. The edge-type backlight module has a plurality of backlight units positioned at least one side of a display area. The local dimming control apparatus includes: a configuration unit, for dividing the display area into a plurality of display blocks; and a local dimming control unit, coupled to the configuration unit, for setting respective backlight intensities of the display blocks through controlling a plurality of luminance settings of the backlight units.

According to another aspect of the present invention, a local dimming control method of an edge-type backlight module is proposed. The edge-type backlight module has a plurality of backlight units positioned at least one side of a display area. The local dimming control method includes the following steps: dividing the display area into a plurality of display blocks; and performing a local dimming control operation to set respective backlight intensities of the display blocks through controlling a plurality of luminance settings of the backlight units.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". Also, the term "couple" is intended to mean either an indirect or direct electrical connection. Accordingly, if one device is coupled to another device, that connection may be through a direct electrical connection, or through an indirect electrical connection via other devices and connections.

Figure 1:
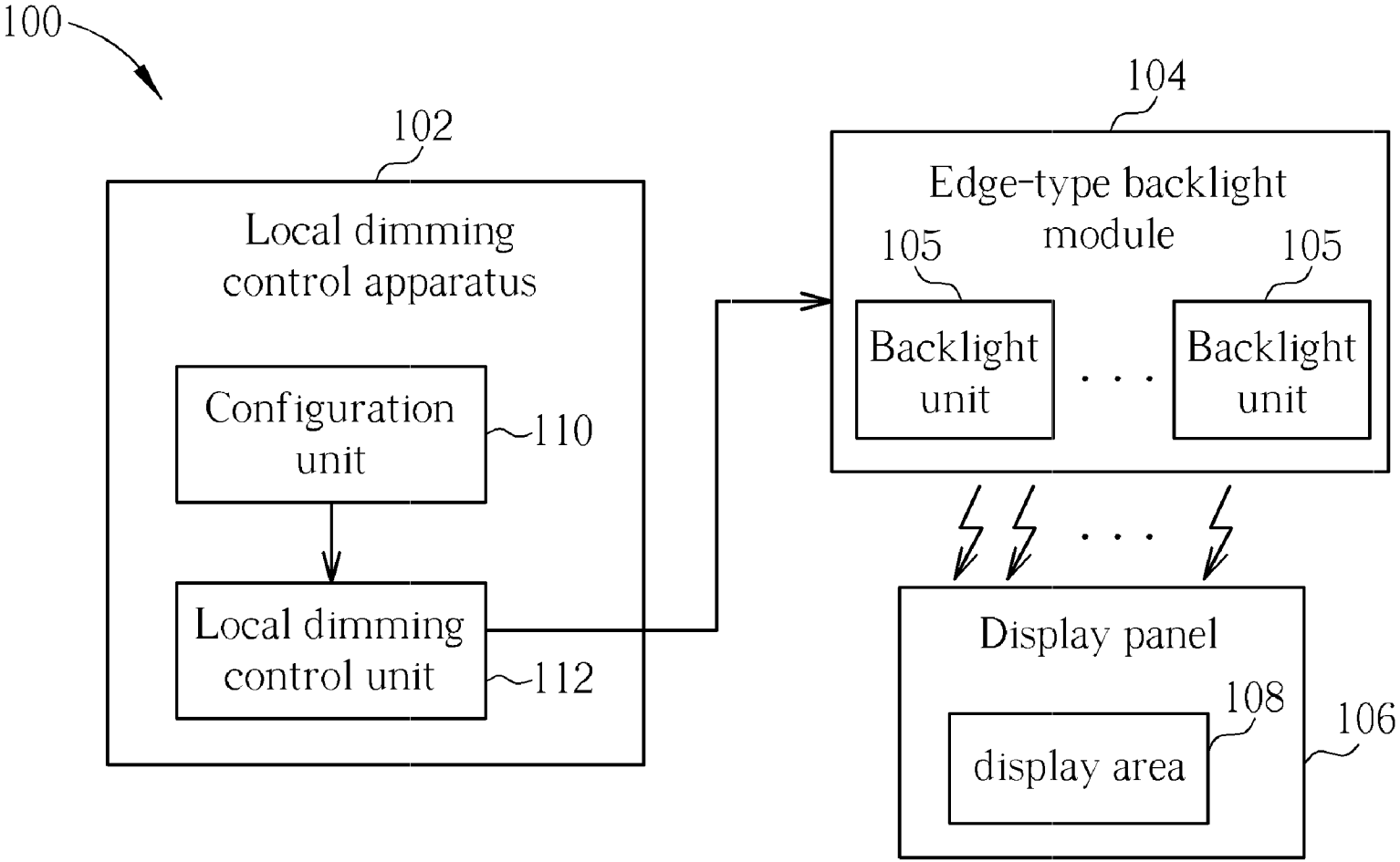
FIG. 1 is a block diagram illustrating a display system according to an exemplary embodiment of the present invention.

FIG. 1 is a block diagram illustrating a display system according to an exemplary embodiment of the present invention. The display system 100 includes, but is not limited to, a local dimming control apparatus 102, an edge-type backlight module 104, and a display panel 106 having a display area 108. In this exemplary embodiment, the edge-type backlight module 104 has a plurality of backlight units 105 positioned at least one side of the display area 108, where each of the backlight units 105 has at least one light source. For example, the edge-type backlight module 104 is a light-emitting diode (LED) backlight module, and each backlight unit 105 contains at least one LED. The display area 108 includes a plurality of pixels. For example, the display panel 108 is a liquid crystal display (LCD) panel, and the pixels thereof are made of LCD units. As shown in FIG. 1, the exemplary local dimming control apparatus 102 includes a configuration unit 110 and a local dimming control unit 120. The configuration unit 110 is devised for dividing the display area 108 into a plurality of display blocks. For each of the display blocks configured by the configuration unit 110, the local dimming control unit 112, coupled to the configuration unit 110, is implemented for setting luminance values (backlight intensities) of the display blocks by controlling a plurality of luminance settings of the backlight units 105. The operation of the exemplary local dimming control apparatus 102 is detailed as follows.

Figure 2:
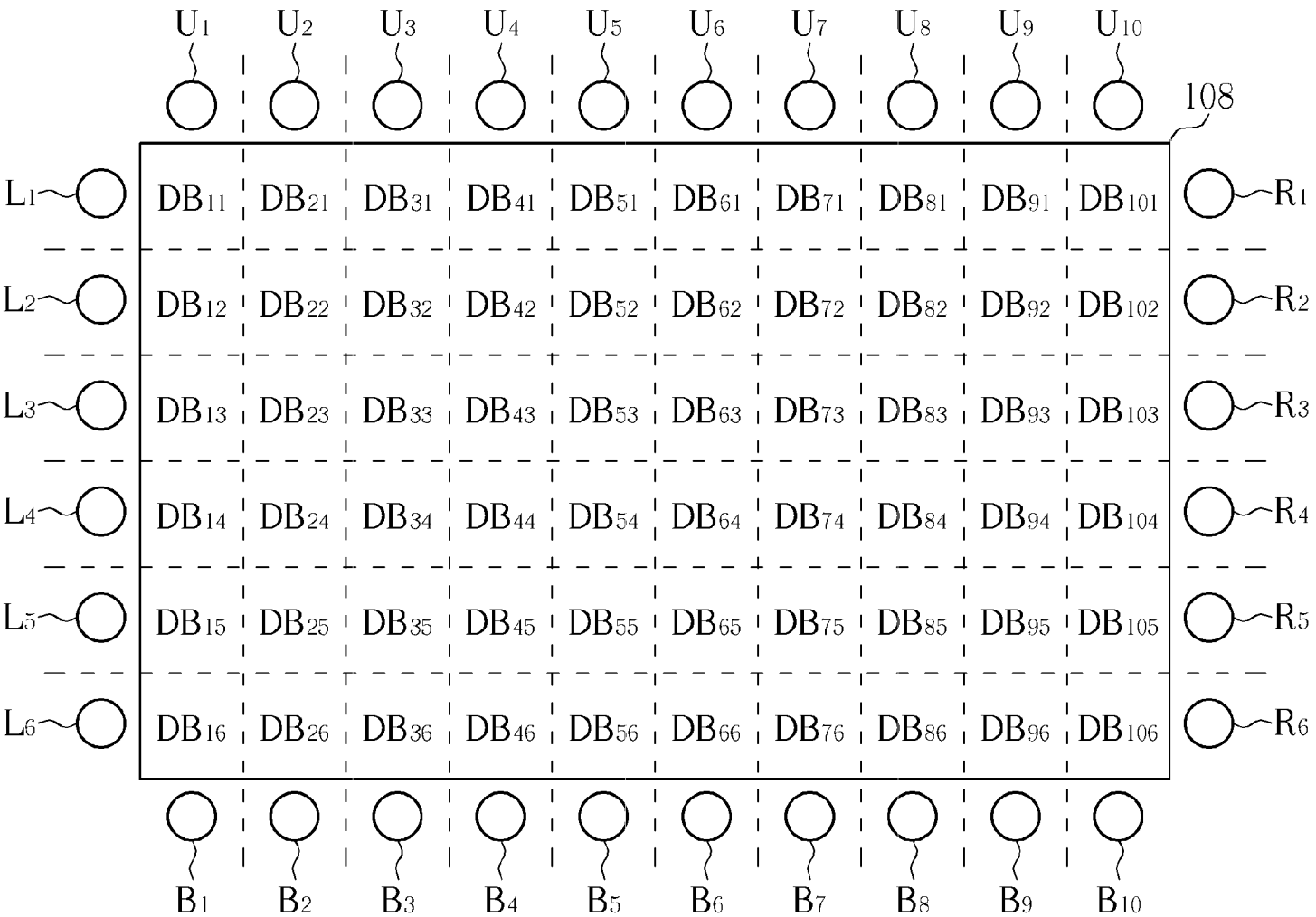
FIG. 2 shows a first panel division of a display panel shown in FIG. 1.

FIG. 2 shows a first panel division of the display panel 106 shown in FIG. 1. Assume that the edge-type backlight module 104 has 2*(10+6) backlight units 105 positioned at four sides of the rectangular display area 108. As shown in FIG. 2, ten backlight units $U_1$-$U_{10}$ are positioned at the top side of the display area 108, ten backlight units $B_1$-$B_{10}$ are positioned at the bottom side of the display area 108, six backlight units $L_1$-$L_6$ are positioned at the left side of the display area 108, and six backlight units $R_1$-$R_6$ are positioned at the right side of the display area 108. Regarding this panel division, the display area 108 of the display panel 106 is divided into 10*6 display blocks $DB_{11}$-$DB_{16}$, $DB_{21}$-$DB_{26}$, . . . , $DB_{101}$-$DB_{106}$.

As mentioned above, the local dimming control unit 112 is devised to set a luminance of each display block by controlling luminance settings of all the backlight units 105. In other words, the luminance value of each display block would be a combination (e.g., a weighted combination) of luminance values of all the backlight units 105. For a display block $DB_{MN}$ indexed by M and N (M=1~10 and N=1~6), the desired luminance $D_{MN}$ thereof can be expressed as follows:

$$D_{MN}=u_{1_MN}\times U_1+u_{2_MN}\times U_2+\ldots+u_{10_MN}\times U_{10}+b_{1_MN}\times B_1+b_{2_MN}\times B_2+\ldots+b_{10_MN}\times B_{10}+l_{1_MN}\times L_1+l_{2_MN}\times L_2+\ldots+l_{6_MN}\times L_6+r_{1_MN}\times R_1+r_{2_MN}\times R_2+\ldots+r_{6_MN}\times R_6 \quad (1)$$

In above equation (1), $u_{1_MN}$-$u_{10_MN}$ are weighting factors of the luminance values of the backlight units $U_1$-$U_{10}$ for the display block $DB_{MN}$, $b_{1_MN}$-$b_{10_MN}$ are weighting factors of the luminance values of the backlight units $B_1$-$B_{10}$ for the display block $DB_{MN}$, $l_{1_MN}$-$l_{6_MN}$ are weighting factors of the luminance values of the backlight units $L_1$-$L_6$ for the display block $DB_{MN}$, and $r_{1_MN}$-$r_{6_MN}$ are weighting factors of the luminance values of the backlight units $R_1$-$R_6$ for the display block $DB_{MN}$. It should be noted that the aforementioned weighting factors $u_{1_MN}$-$u_{10_MN}$, $b_{1_MN}$-$b_{10_MN}$, $l_{1_MN}$-$l_{6_MN}$ and $r_{1_MN}$-$r_{6_MN}$ for the display block $DB_{MN}$ are fixed and pre-defined according to optical characteristics of the backlight units $U_1$-$U_{10}$, $B_1$-$B_{10}$, $L_1$-$L_6$ and $R_1$-$R_6$. More specifically, with a proper design of a light guide plate of the edge-type backlight module 104, a luminance contribution of a backlight unit may be uniform within the target display block $DB_{MN}$. Thus, a weighting factor of the backlight unit is therefore constant and known.

At the condition that local dimming control is employed, the desired luminance $D_{MN}$ of each display block $DB_{MN}$ (M=1~10 and N=1~6) may be determined by pixel data content of each display block $DB_{MN}$ and is known. The desired luminance of each of the display blocks $DB_{11}$-$DB_{16}$, $DB_{21}$-$DB_{26}$, . . . , $DB_{101}$-$DB_{106}$ can be expressed according to equation (1). Taking the display blocks $DB_{11}$ and $DB_{12}$ for example, the desired luminance $D_{11}$ and $D_{12}$ thereof can be expressed as follows.

$$D_{11}=u_{1_11}\times U_1+u_{2_11}\times U_2+\ldots+u_{10_11}\times U_{10}+b_{1_11}\times B_1+b_{2_11}\times B_2+\ldots+b_{10_11}\times B_{10}+l_{1_11}\times L_1+l_{2_11}\times L_2+\ldots+l_{6_11}\times L_6+r_{1_11}\times R_1+r_{2_11}\times R_2+\ldots+r_{6_11}\times R_6 \quad (2)$$

$$D_{12}=u_{1_12}\times U_1+u_{2_12}\times U_2+\ldots+u_{10_12}\times U_{10}+b_{1_12}\times B_1+b_{2_12}\times B_2+\ldots+b_{10_12}\times B_{10}+l_{1_12}\times L_1+l_{2_12}\times L_2+\ldots+l_{6_12}\times L_6+r_{1_12}\times R_1+r_{2_12}\times R_2+\ldots+r_{6_12}\times R_6 \quad (3)$$

As there are 10*6 display blocks $DB_{11}$-$DB_{16}$, $DB_{21}$-$DB_{26}$, . . . , $DB_{101}$-$DB_{106}$, 10*6 equations are required to express the desired luminance values of the display blocks $DB_{11}$-$DB_{16}$, $DB_{21}$-$DB_{26}$, . . . , $DB_{101}$-$DB_{106}$ in terms of luminance values of the backlight units $U_1$-$U_{10}$, $B_1$-$B_{10}$, $L_1$-$L_6$ and $R_1$-$R_6$; however, only 2*(10+6) variables (i.e., luminance values of backlight units $U_1$-$U_{10}$, $B_1$-$B_{10}$, $L_1$-$L_6$ and $R_1$-$R_6$ to be controlled) are included therein due to the fact that the desired luminance values (i.e., $D_{11}$-$D_{16}$, $D_{21}$-$D_{26}$, . . . , $D_{101}$-$D_{106}$) and all the weighting factors are known. Since the number of variables is smaller than the number of equations (i.e., 2*(10+6)<10*6), no solution can be successfully found. As a result, the local dimming control would fail under such a panel division.

Figure 7:
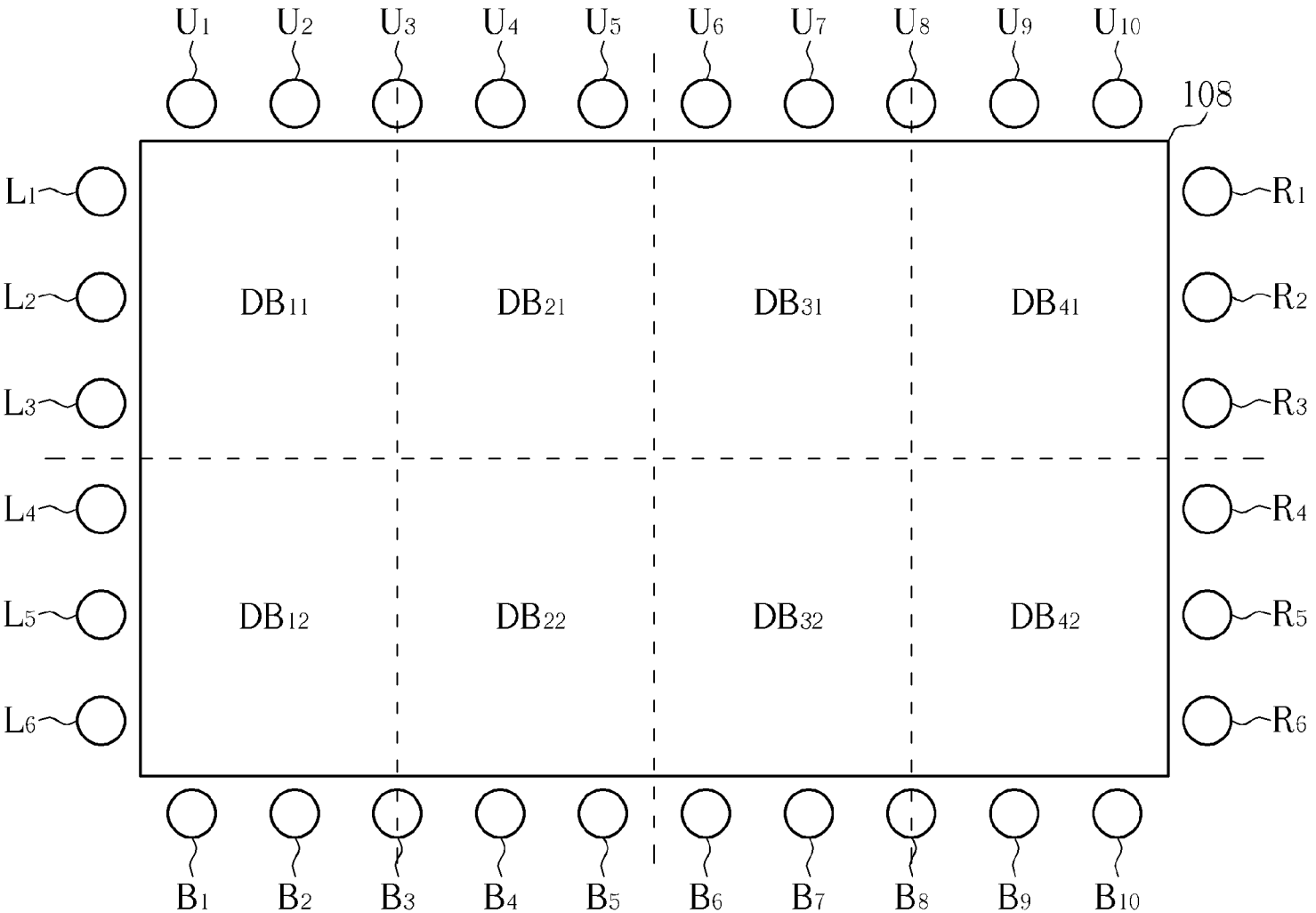
FIG. 7 shows a fifth panel division of the display panel shown in FIG. 1.

To solve the above-mentioned problem, the configuration unit 110 is particularly devised to divide the display area 108 into a plurality of display blocks according to the number of the backlight units 105 included in the edge-type backlight module 104. In one implementation, the number of the configured display blocks is equal to the number of the backlight units 105. Thus, only one solution would be found since the number of variables is equal to the number of equations. By way of example, based on the found solution, the backlight intensity provided by a backlight unit may be zero or other luminance value. In another implementation, the number of the configured display blocks is smaller than the number of the backlight units as shown in FIG. 7, which illustrates a fifth panel division of the display panel shown in FIG. 1. Thus, more than one solution would be found since the number of variables is smaller than the number of equations. It should be noted that any of the solutions can be used to set the luminance values of the backlight units 105.

Figure 3:
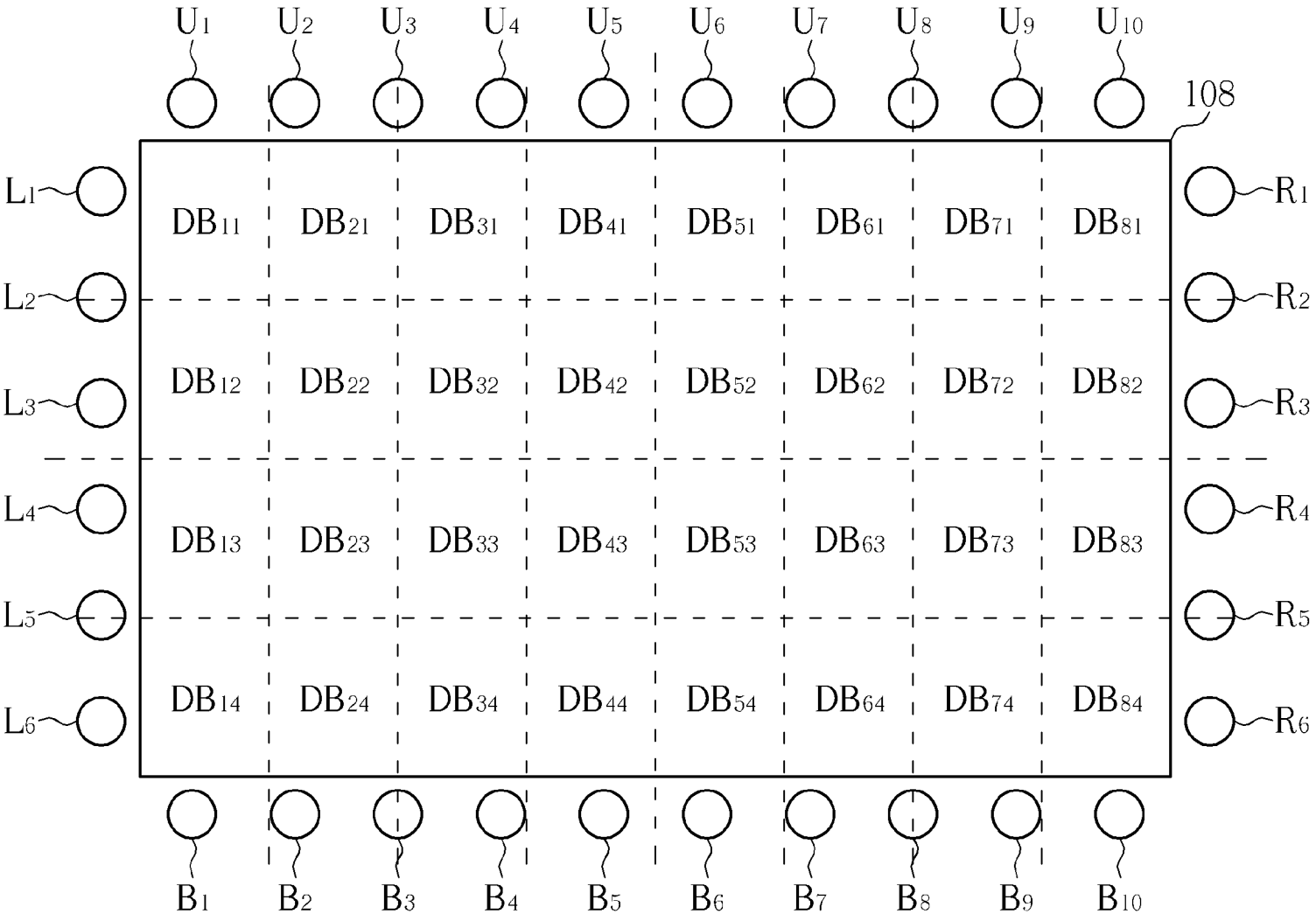
FIG. 3 shows a second panel division of the display panel shown in FIG. 1.

FIG. 3 shows a second panel division of the display panel 106 shown in FIG. 1. The display blocks $DB_{11}$-$DB_{14}$, $DB_{21}$-$DB_{24}$, . . . , $DB_{81}$-$DB_{84}$ are configured by the configuration unit 110 and arranged in a matrix format. As the local dimming control unit 112 sets a luminance of each display block by controlling luminance settings of all the backlight units 105, the luminance value of each display block is a combination (e.g., a weighted combination) of luminance values of all the backlight units 105. Therefore, for a display block $DB_{MN}$ indexed by M and N (M=1~8 and N=1~4), the desired luminance $D'_{MN}$ under the panel division shown in FIG. 3 can be expressed as follows:

$$D'_{MN}=u'_{1_MN}\times U_1+u'_{2_MN}\times U_2+\ldots+u'_{10_MN}\times U_{10}+b'_{1_MN}\times B_1+b'_{2_MN}\times B_2+\ldots+b'_{10_MN}\times B_{10}+l'_{1_MN}\times L_1+l'_{2_MN}\times L_2+\ldots+l'_{6_MN}\times L_6+r'_{1_MN}\times R_1+r'_{2_MN}\times R_2+\ldots+r'_{6_MN}\times R_6 \quad (4)$$

As there are 8*4 display blocks $DB_{11}$-$DB_{14}$, $DB_{21}$-$DB_{24}$, . . . , $DB_{81}$-$DB_{84}$, 8*4 equations are required to express the desired luminance values of the display blocks $DB_{11}$-$DB_{14}$, $DB_{21}$-$DB_{24d}$, . . . , $DB_{81}$-$DB_{84}$. In this embodiment, 2*(10+6) variables (i.e., luminance values of backlight units $U_1$-$U_{10}$, $B_1$-$B_{10}$, $L_1$-$L_6$ and $R_1$-$R_6$ to be controlled) are included in the equations due to the fact that the desired luminance values (i.e., $D'_{11}$-$D'_{14}$, $D'_{21}$-$D'_{24}$, . . . , $D'_{81}$-$D'_{84}$) of the display blocks and all the weighting factors are known. Since the number of variables is equal to the number of equations (i.e., 2*(10+6)=8*4), only one solution can be found. Thus, the local dimming control can be successfully realized by referring to the found solution.

Figure 4:
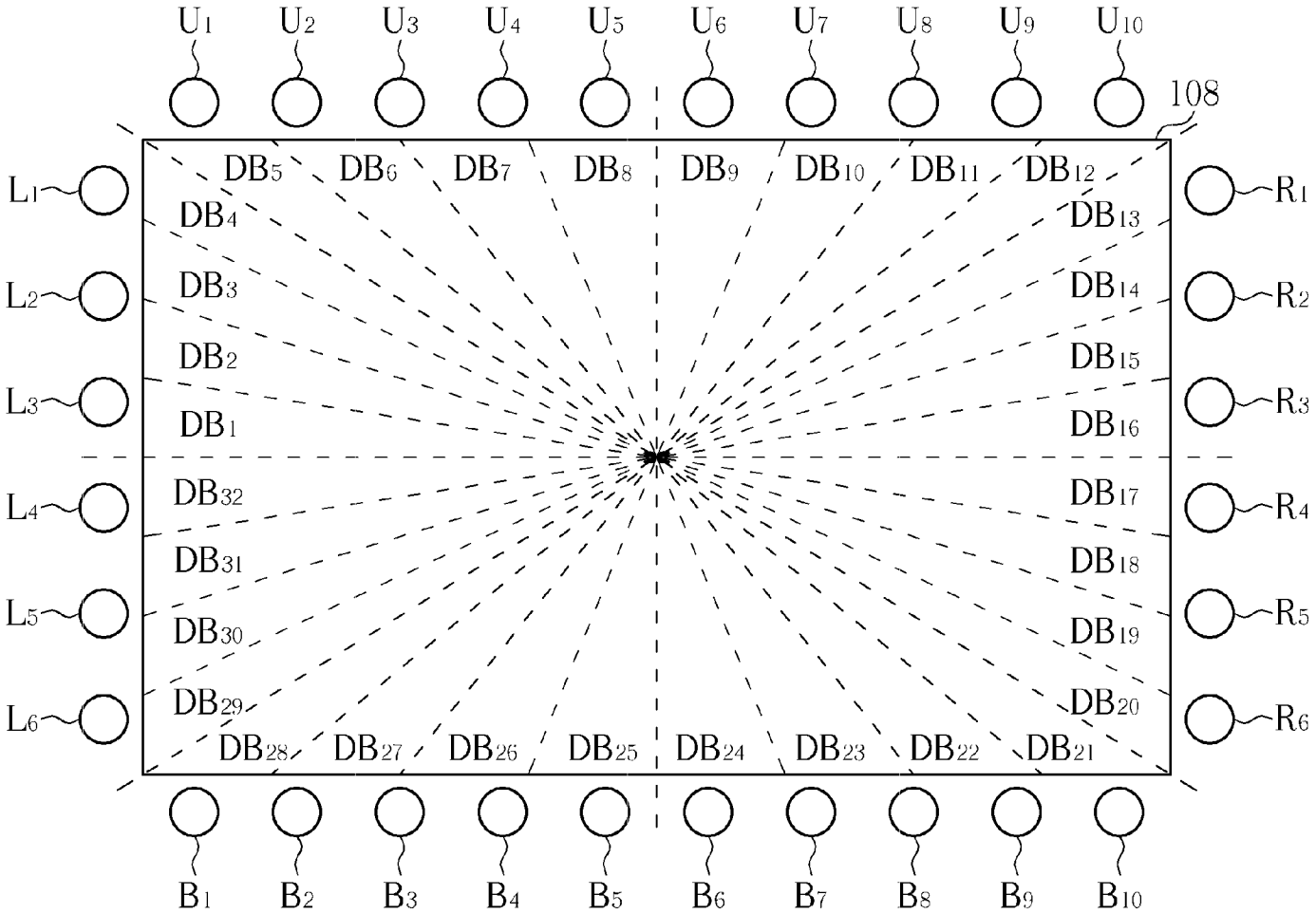
FIG. 4 shows a third panel division of the display panel shown in FIG. 1.

FIG. 4 shows a third panel division of the display panel 106 shown in FIG. 1. The display blocks $DB_1$-$DB_{32}$ are configured by the configuration unit 110 and arranged in a radial format. As the local dimming control unit 112 sets a luminance of each display block by controlling luminance settings of all the backlight units 105, the luminance value of each display block is a combination (e.g., a weighted combination) of luminance values of all the backlight units 105. Therefore, for a display block $DB_M$ indexed by M (M=1~32), the desired luminance $D_M$ under the panel division shown in FIG. 4 can be similarly expressed as follows:

$$D_M=u_{1_M}\times U_1+u_{2_M}\times U_2+\ldots+u_{10_M}\times U_{10}+b_{1_M}\times B_1+b_{2_M}\times B_2+\ldots+b_{10_M}\times B_{10}+l_{1_M}\times L_1+l_{2_M}\times L_2+\ldots+l_{6_M}\times L_6+r_{1_M}\times R_1+r_{2_M}\times R_2+\ldots+r_{6_M}\times R_6 \quad (5)$$

As there are 8*4 display blocks $DB_1$-$DB_{32}$, 8*4 equations are required to express the desired luminance values of the display blocks $DB_1$-$DB_{32}$. In this embodiment, 2*(10+6) variables (i.e., luminance values of backlight units $U_1$-$U_{10}$, $B_1$-$B_{10}$, $L_1$-$L_6$ and $R_1$-$R_6$ to be controlled) are included in the equations due to the fact that the desired luminance values (i.e., $D_1$-$D_{32}$) of the display blocks and all the weighting factors are known. Since the number of variables is equal to the number of equations (i.e., 2*(10+6)=8*4), only one solution can be found. Thus, the local dimming control can be successfully realized by referring to the found solution.

Figure 5:
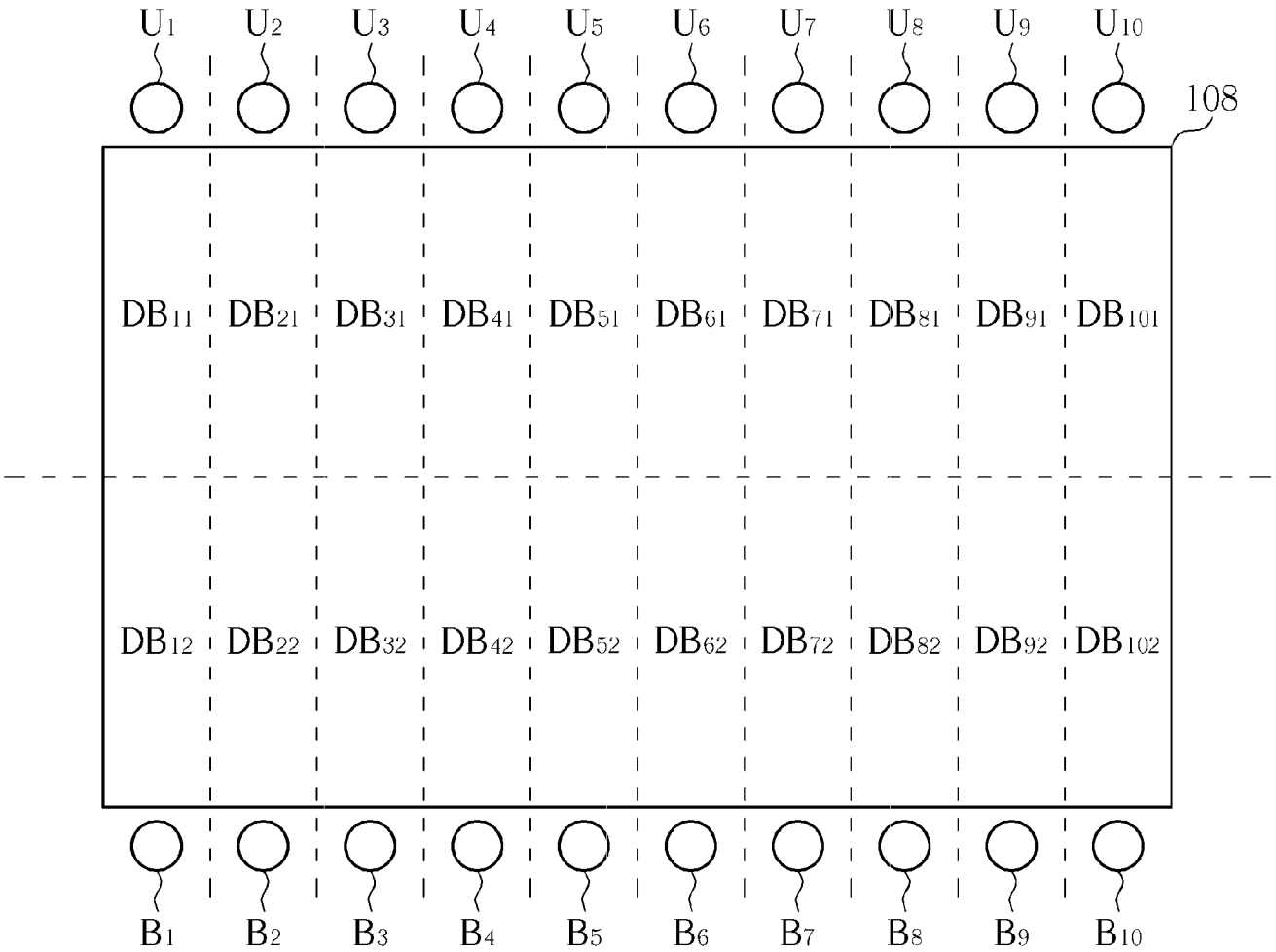
FIG. 5 shows a fourth panel division of the display panel shown in FIG. 1.

In above exemplary embodiments, the edge-type backlight module 104 has backlight units 105 positioned at four sides of the rectangular display area 108. However, regarding a case where the edge-type backlight module 104 has backlight units 105 that are not positioned at all sides of the rectangular display area 108, the same objective of performing local dimming control upon the edge-type backlight module 104 can be achieved. Please refer to FIG. 5, which shows a fourth panel division of the display panel 106 shown in FIG. 1. Assume that the edge-type backlight module 104 has 2*10 backlight units 105 positioned at two sides of the rectangular display area 108. As shown in FIG. 5, ten backlight units $U_1$-$U_{10}$ are positioned at the top side of the display area 108, and ten backlight units $B_1$-$B_{10}$ are positioned at the bottom side of the display area 108. In this exemplary panel division, the display area 108 of the display panel 106 is divided into 10*2 display blocks $DB_{11}$-$DB_{16}$, $DB_{21}$-$DB_{22}$, . . . , $DB_{101}$-$DB_{102}$, and the display blocks $DB_{11}$-$DB_{16}$, $DB_{21}$-$DB_{22}$, . . . , $DB_{101}$-$DB_{102}$ configured by the configuration unit 110 are arranged in a matrix format. As the local dimming control unit 112 sets a luminance value of each display block by controlling luminance settings of all the backlight units 105, the luminance value of each display block is a combination (e.g., a weighted combination) of luminance values of all the backlight units 105. Therefore, for a display block $DB_{MN}$ indexed by M and N (M=1~10 and N=1~2), the desired luminance $D''_{MN}$ under the panel division shown in FIG. 5 can be similarly expressed as follows:

$$D''_{MN}=u''_{1_MN}\times U_1+u''_{2_MN}\times U_2+\ldots+u''_{10_MN}\times U_{10}+b''_{1_MN}\times B_1+b''_{2_MN}\times B_2+\ldots+b''_{10_MN}\times B_{10} \quad (6)$$

As there are 10*2 display blocks $DB_{11}$-$DB_{21}$, $DB_{21}$-$DB_{22}$, . . . , $DB_{101}$-$DB_{102}$, 10*2 equations are required to express the desired luminance values of the display blocks $DB_{11}$-$DB_{21}$, $DB_{21}$-$DB_{22}$, . . . , $DB_{101}$-$DB_{102}$. In addition, 2*10 variables (i.e., luminance values of backlight units $U_1$-$U_{10}$ and $B_1$-$B_{10}$ to be controlled) are included in the equations due to the fact that the desired luminance values (i.e., $D''_{11}$-$D''_{12}$, $D''_{21}$-$D''_{22}$, . . . , $D''_{101}$-$D''_{102}$) of the display blocks and all the weighting factors are known. Since the number of variables is equal to the number of equations, only one solution can be found. Thus, the local dimming control can be successfully realized by referring to the found solution.

Provided that the light guide plate and/or other optical component(s) in the backlight module are properly designed to make weighting factors of the backlight units 105 constant for each display block configured by the configuration unit 110, the local dimming control can be successfully performed upon each display block through controlling luminance settings of all backlight units 105 as long as the configuration unit 110 divides the display area 108 of the display panel 106 into display blocks whose number is not greater than the number of the backlight units 105. It should be noted that the size and/or the shape of the configured display block can be adjustable, depending upon design requirements. For example, the display blocks are not required to be arranged in the matrix format or radial format, and the display blocks are not required to have the same size/shape. These alternative panel division designs all fall within the scope of the present invention.

Briefly summarized, as long as backlight intensities of a plurality of display blocks in a display area can be respectively set by using the same backlight control which includes luminance settings of a plurality of backlight units positioned at one or more sides of the display area, any rule of defining the display blocks in the display area can be employed by the configuration unit 110 shown in FIG. 1.

Figure 6:
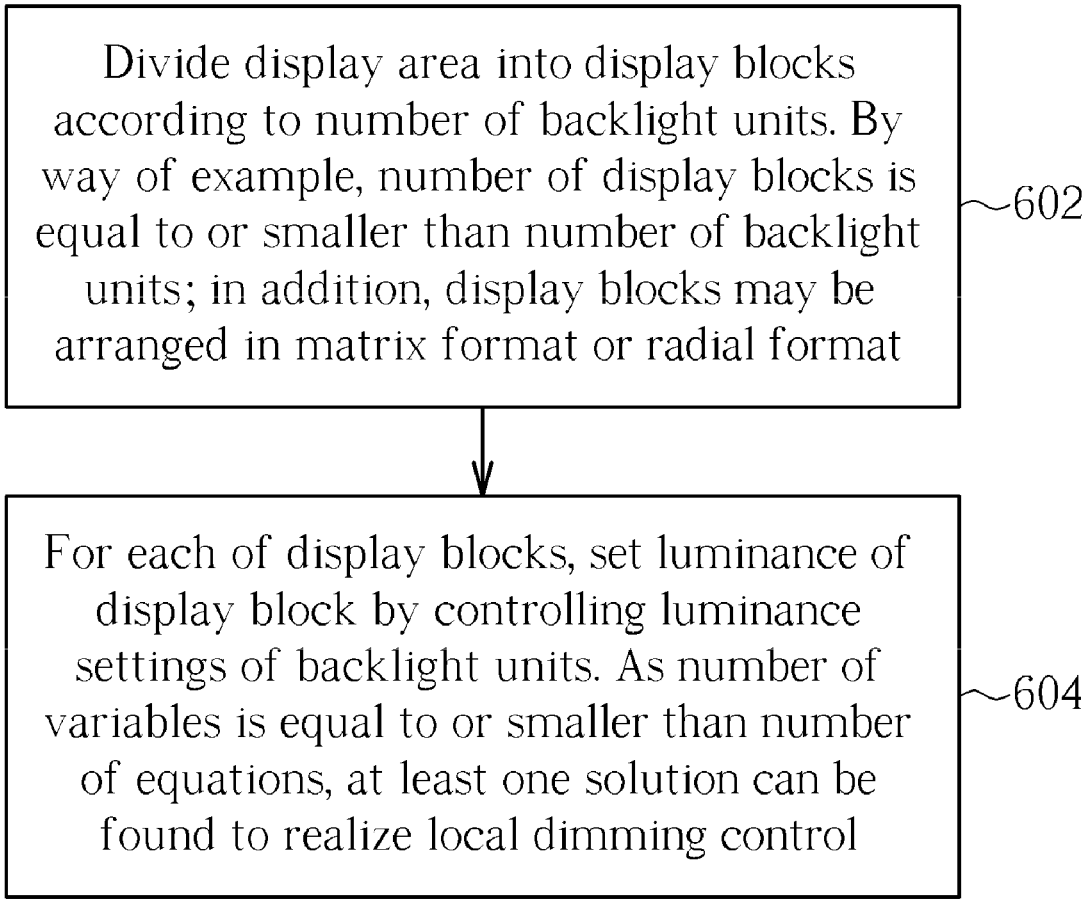
FIG. 6 is a flowchart of a generalized local dimming control method of an edge-type backlight module according to an exemplary embodiment of the present invention.

FIG. 6 is a flowchart of a generalized local dimming control method of an edge-type backlight module according to an exemplary embodiment of the present invention. The edge-type backlight module has a plurality of backlight units positioned at sides of a display area. If the result is substantially the same, the steps are not required to be executed in the exact order shown in FIG. 6. The exemplary local dimming control method can be briefly summarized as follows.

Step 602: Divide the display area into a plurality of display blocks according to the number of the backlight units. By way of example, the number of the display blocks is equal to or smaller than the number of the backlight units; in addition, the display blocks may be arranged in a matrix format or a radial format.

Step 604: For each of the display blocks, set a luminance value (backlight intensity) of the display block by controlling a plurality of luminance settings of the backlight units. Therefore, the local dimming control applied to the backlight intensities of the display blocks is achieved through controlling the luminance settings of the backlight units. As the number of variables is equal to or smaller than the number of equations, at least one solution can be found. Thus, based on the found solution of the luminance settings (luminance values) of the backlight units, the local dimming control can be successfully realized.

As the details of the exemplary local dimming control method can be found in above paragraphs directed to the diagrams shown in the accompanying drawings, further description is omitted here for brevity.

Those skilled in the art will readily observe that numerous modifications and alterations of the device and method may be made while retaining the teachings of the invention.

What is claimed is:

1. A local dimming control apparatus of an edge-type backlight module having a plurality of backlight units positioned at at least one side of a display area, comprising:

a configuration unit, for dividing the display area into a plurality of display blocks; and a local dimming control unit, coupled to the configuration unit, for setting respective backlight intensities of the display blocks through controlling a plurality of luminance settings of the backlight units.

2. The local dimming control apparatus of claim 1, wherein the display area is rectangular, and the backlight units are positioned at four sides of the display area.

3. The local dimming control apparatus of claim 2, wherein the configuration unit divides the display area into the display blocks according to a number of the backlight units, where a number of the display blocks is equal to the number of the backlight units.

4. The local dimming control apparatus of claim 2, wherein the configuration unit divides the display area into the display blocks according to a number of the backlight units, where a number of the display blocks is smaller than the number of the backlight units.

5. The local dimming control apparatus of claim 2, wherein the configuration unit configures the display blocks in a matrix format.

6. The local dimming control apparatus of claim 2, wherein the configuration unit configures the display blocks in a radial format.

7. The local dimming control apparatus of claim 1, wherein the configuration unit divides the display area into the display blocks according to a number of the backlight units, where a number of the display blocks is equal to the number of the backlight units.

8. The local dimming control apparatus of claim 1, wherein the configuration unit divides the display area into the display blocks according to a number of the backlight units, where a number of the display blocks is smaller than the number of the backlight units.

9. The local dimming control apparatus of claim 1, wherein the configuration unit configures the display blocks in a matrix format.

10. The local dimming control apparatus of claim 1, wherein the configuration unit configures the display blocks in a radial format.

11. A local dimming control method of an edge-type backlight module having a plurality of backlight units positioned at least one side of a display area, comprising:

dividing the display area into a plurality of display blocks; and performing a local dimming control operation to set respective backlight intensities of the display blocks through controlling a plurality of luminance settings of the backlight units.

12. The local dimming control method of claim 11, wherein the display area is rectangular, and the backlight units are positioned at four sides of the display area.

13. The local dimming control method of claim 12, wherein the step of dividing the display area comprises:

dividing the display area into the display blocks according to a number of the backlight units, where a number of the display blocks is equal to the number of the backlight units.

14. The local dimming control method of claim 12, wherein the step of dividing the display area comprises:

dividing the display area into the display blocks according to a number of the backlight units, where a number of the display blocks is smaller than the number of the backlight units.

15. The local dimming control method of claim 12, wherein the display blocks are arranged in a matrix format.

16. The local dimming control method of claim 12, wherein the display blocks are arranged in a radial format.

17. The local dimming control method of claim 11, wherein the step of dividing the display area comprises:

dividing the display area into the display blocks according to a number of the backlight units, where a number of the display blocks is equal to the number of the backlight units.

18. The local dimming control method of claim 11, wherein the step of dividing the display area comprises:

dividing the display area into the display blocks according to a number of the backlight units, where a number of the display blocks is smaller than the number of the backlight units.

19. The local dimming control method of claim 11, wherein the display blocks are arranged in a matrix format.

20. The local dimming control method of claim 11, wherein the display blocks are arranged in a radial format.

* * * * *